US008044317B2

(12) United States Patent
Marquezin et al.

(10) Patent No.: US 8,044,317 B2
(45) Date of Patent: Oct. 25, 2011

(54) CIRCUIT BREAKER HAVING A PLURALITY OF BREAKER CHAMBERS ARRANGED IN PARALLEL, WITH A COMMON TRANSMISSION AND REDUCED LENGTH

(75) Inventors: Gwenael Marquezin, Villeurbanne (FR); Andre Cimala, Villeurbanne (FR)

(73) Assignee: Areva T&D SA, Paris la Defense Cedex (FR)

( * ) Notice: Subject to any disclaimer, the term of this patent is extended or adjusted under 35 U.S.C. 154(b) by 492 days.

(21) Appl. No.: 12/347,877

(22) Filed: Dec. 31, 2008

(65) Prior Publication Data

US 2009/0166333 A1 Jul. 2, 2009

(30) Foreign Application Priority Data

Jan. 2, 2008 (FR) ..... 08 50007

(51) Int. Cl.
*H01H 33/12* (2006.01)

(52) U.S. Cl. ..... 218/5; 200/50.22

(58) Field of Classification Search ..... 218/1–7; 200/50.22

See application file for complete search history.

(56) References Cited

U.S. PATENT DOCUMENTS 3,691,332 A * 9/1972 Sharp ..... 218/119
3,793,494 A * 2/1974 Cleaveland ..... 200/50.22
3,895,202 A 7/1975 Okerman et al.
4,027,123 A * 5/1977 Ihara ..... 218/4
4,562,319 A 12/1985 Badon et al.
4,769,740 A * 9/1988 Wagenbach et al. ..... 361/619
5,347,096 A 9/1994 Bolongeat-Mobleu et al.
5,663,544 A * 9/1997 Niemeyer ..... 218/3
5,668,360 A * 9/1997 Perret et al. ..... 218/5
6,560,091 B1 * 5/2003 Takahoshi et al. ..... 361/604
6,631,075 B2 * 10/2003 Kashima et al. ..... 361/605

FOREIGN PATENT DOCUMENTS

FR 2682807 A 4/1993

OTHER PUBLICATIONS

French Preliminary Search Report dated Jul. 23, 2008.

* cited by examiner

*Primary Examiner* — Truc Nguyen
(74) *Attorney, Agent, or Firm* — Nixon Peabody LLP

(57) ABSTRACT

A high or very high voltage circuit breaker comprising, for each phase:

at least two breaker chambers connected electrically in series and disposed parallel to each other in a metal tank, in which the ends of the chambers through which at least one pair of movable contacts of each chamber is driven lie in a common plane; and the mechanical transmission assembly whereby simultaneous movement is transmitted, and which ensures identical stroke lengths for the movements of the movable contacts of at least two chambers, comprises firstly at least two bars of identical lengths, each coupled to the pair of movable contacts of one of the chambers, and secondly, drive means coupled to at least one drive rod outside the tank or passing through its wall.

15 Claims, 2 Drawing Sheets

CIRCUIT BREAKER HAVING A PLURALITY OF BREAKER CHAMBERS ARRANGED IN PARALLEL, WITH A COMMON TRANSMISSION AND REDUCED LENGTH

CROSS REFERENCE TO RELATED APPLICATIONS OR PRIORITY CLAIM

This application claims priority to French Patent Application No. 08 50007, filed Jan. 2, 2008.

DESCRIPTION

1. Technical field

This invention relates to the field of high voltage and very high voltage circuit breakers (of the metal-clad and dead tank types), comprising, for each phase, at least two breaker chambers connected electrically in series and having a common transmission.

Putting the breaker chambers in series makes it possible, when breaking a fault current (for example a short-circuit current), to spread the voltage between the said chambers, thereby facilitating extinction of the arc.

2. Prior Art

At the present time, a high or very high voltage circuit breaker may have several, typically three, breaker chambers in alignment with one another.

In order to transmit the motion of a first breaker chamber to a second chamber, insulating drawbars outside the chambers are used for opening all of the movable contacts at once. The use of such drawbars involves the need also to make use of covers and to arrange for long insulating distances, that is to say significant distances between the said drawbars at the line voltage and the metal tanks, which are at ground potential.

For example, the document U.S. Pat. No. 3,895,202 may be cited, which teaches a transmission common to four breaker chambers aligned with each other, the transmission consisting of two external drawbars 80 and 82.

The document U.S. Pat. No. 4,562,319, which is an improvement on U.S. Pat. No. 3,895,202, also teaches a transmission common to four breaker chambers aligned with one another and offset in parallel, lengthwise in pairs, the transmission being again in the form of external drawbars.

Those known structures thus give a very long circuit breaker. In addition, the mechanical parts used for the transmission, and their arrangement, can give rise to difficulties. When being driven, the mechanical parts are deformed, and this puts the chambers out of synchronism with one another, even when the circuit breaker has been correctly adjusted in slow-motion operation. Drawbar transmission also involves a substantial excess of moving mass, which leads to larger components and to high loads. Moreover, it is necessary to provide guidance for movement of components, while preventing rotation and ensuring that the components designed to pass through the parts constituting the support for the breaker chambers will do so.

In order to mitigate those disadvantages, the Applicant has proposed, in Patent Application FR 0 758 322, an improvement which, in particular, enables the total length of the circuit breaker to be reduced, with breaker chambers aligned with one another, and which simplifies the mechanical transmission means and their arrangement.

The object of the invention is accordingly to propose a further solution that enables the total length of the circuit breaker to be reduced and that resolves difficulties in the transmission of motion to all the breaker chambers.

SUMMARY OF THE INVENTION

To this end, in a first aspect, the invention provides a high or very high voltage circuit breaker comprising, for each phase, a metal tank in which there are mounted at least two breaker chambers connected electrically in series with each other, each breaker chamber including a pair of main contacts and a pair of arcing contacts, each of which is integral with one of the main contacts, wherein:

the breaker chambers are arranged parallel to each other in the tank;

the ends of the chambers, through which at least one pair of movable contacts of each chamber is driven, are situated in a common plane; and the mechanical transmission assembly, which effects the simultaneous transmission of movement and which determines identical path lengths for the movement of the movable contacts of at least two said chambers, comprises, firstly, at least two bars of identical lengths, each of which is coupled with the pair of movable contacts of one of the said chambers, and secondly, drive means coupled to the said bars and adapted to be coupled to at least one drive rod outside the tank or extending through a wall of the tank.

The invention reduces to a minimum the distance between the starting points of the movement in each chamber and the control means (i.e. the drive rod or rods). This enables not only the total length to be reduced, but also the overall length of the circuit breaker (that is to say, the overall longitudinal dimension of the circuit breaker including that of the tank), in spite of the fact that the tank incorporates at least two breaker chambers. In the configuration in which the actuating means are arranged at least partly outside the tank, the overall length to be considered is the overall length including that of the actuating means in the extreme open position in a current breaking operation. In addition, transport and installation of the circuit breaker of the invention are both made easier.

Finally, the invention improves equal distribution of voltage over at least two breaker chambers, because parasitic capacitances between the breaker chambers and the tank are reduced.

The operation achieved by the rod according to the invention is exclusively a translation motion that separates each moveable contact from the fixed contact of a given pair in a same chamber in a translating way along the axis of said chamber.

The interrupter chambers are modules in which the principal contacts and the arcing contacts are arranged coaxially.

In an advantageous embodiment, the circuit breaker of the invention has either three or four breaker chambers.

In one embodiment, each pair of contacts consists of two movable contacts, with additional transmission means being provided for each chamber to separate its main and arcing contacts from each other during a current breaking operation.

Two alternative ways of providing control may be provided. The drive means coupled to the bars, and the drive rods, may perform separate control functions.

The drive means coupled to the said bars may, as an alternative, comprise a yoke adapted to be coupled to a single drive rod.

The word "yoke" is to be understood to mean here, and in the context of the invention, any mechanical device that enables each of the bars to be itself coupled to a pair of movable contacts of a breaker chamber, and that permits the concomitant transmission of the motion of those contacts to the bars, with, for each bar, a fair distribution of the tensile or compressive force generated by the drive rod. In the advantageous (preferred) embodiment having three breaker chambers, the yoke provides coupling to all three bars (all of equal lengths) of those chambers, with concomitant transmission of the motion to those three bars, and with, for each bar, a fair distribution of one third of the tensile or compressive force generated by the drive rod.

In one version, the yoke is arranged outside the tank.

In an alternative version, the yoke is arranged inside the tank.

The yoke may be made of an electrically insulating material and is coupled to the drive rod, which is made of an electrically conductive material.

Alternatively, the yoke may be made of an electrically conductive material and is coupled to the bars, which are made of electrically insulating material.

Preferably, the mechanical retention of the breaking chambers in the tank is effected, only on the side of the circuit breaker that faces the drive rod or rods, by insulating elements in the form of sleeves that are fixed to the wall of the tank.

Preferably again, the circuit breaker includes electrical connecting elements between the breaking chambers that serve for current output, at least a portion of the said elements being arranged parallel to the plane in which are situated the ends of the said breaking chambers through which the pair of movable contacts of each chamber is driven.

In a further version in which only two breaking chambers are arranged inside the metal tank, the electrical connecting elements comprise a metal bar also arranged inside the tank, parallel to the chambers, the bar being connected to the portions of the electrical connecting elements that are disposed parallel to the plane of the ends of the said chambers through which the pair of movable contacts of each chamber are driven.

The breaking chambers may be made with vacuum chambers.

The circuit breaker of the invention may be disposed in an orientation other than horizontal, as part of a dead tank.

The invention also provides the use of a circuit breaker of the kind set forth above as part of a metalclad switchgear unit (GIS).

Finally, the invention provides a method of mounting a circuit breaker of the kind set forth above, including a step of making a sub-assembly consisting, at least, of two breaking chambers, and of drive means to be coupled to the bars, assembled on a cover member of the tank, and in which at least the two said breaking chambers are then fitted in the tank by closing the body of the tank with the sub-assembly.

BRIEF DESCRIPTION OF THE DRAWINGS

Further advantages and features of the invention will appear more clearly on a reading of the following detailed description with reference to the attached drawings.

DETAILED DESCRIPTION OF PARTICULAR EMBODIMENTS

The high or very high voltage circuit breaker D shown includes, in each phase, three breaker chambers Ca, Cb, and Cc that constitute modules arranged in a metal tank 1.

Each chamber Ca, Cb, Cc includes, respectively, a pair of main contacts 2*a* and 3*a*, 2*b* and 3*b*, and a pair of arcing contacts 4*a* and 5*a*, 4*b* and 5*b*, each of which is fastened to one of the main contacts in mating relationship of complementary male and female portions. Each pair of contacts includes a single movable main contact 2*a* or 2*b*, or a single movable arcing contact 4*a* or 4*b* (see FIGS. 1A and 2). The contacts of the third chamber are omitted for clarity.

In the embodiments shown, the three chambers Ca, Cb, and Cc are identical to one another.

Figure 1A:
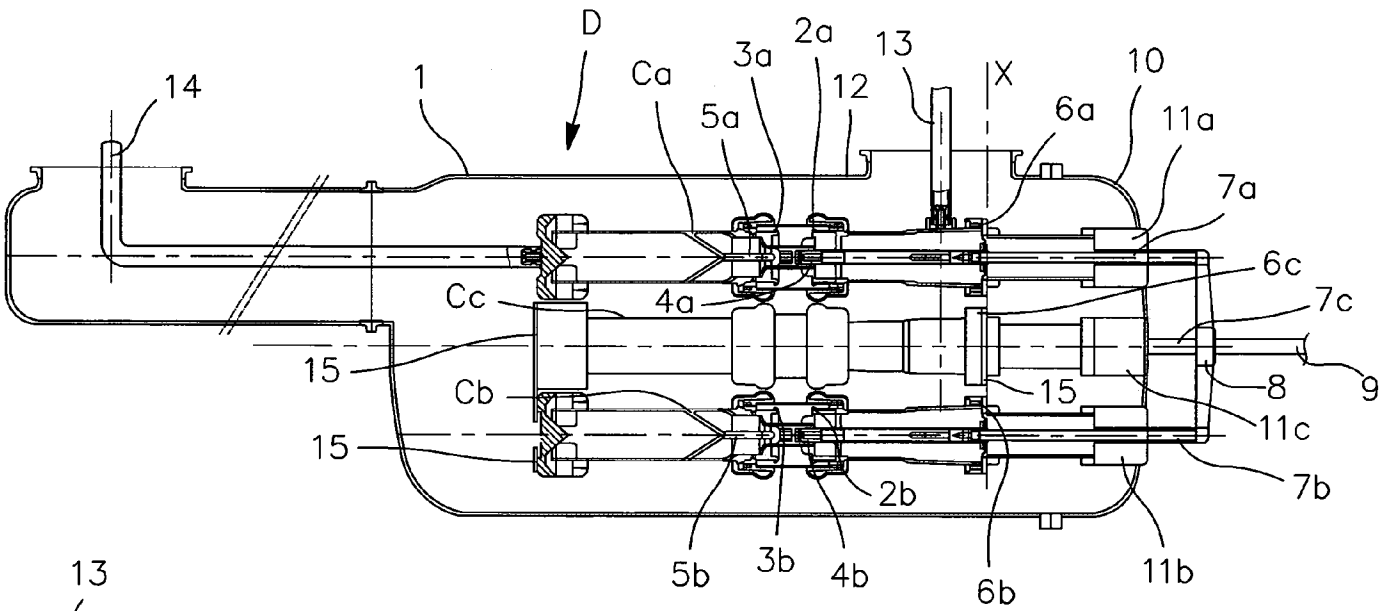
FIG. 1A is a cross section taken on the line A-A in FIG. 1 and showing the circuit breaker in its open position, that is to say after breaking a current.
Figure 2:
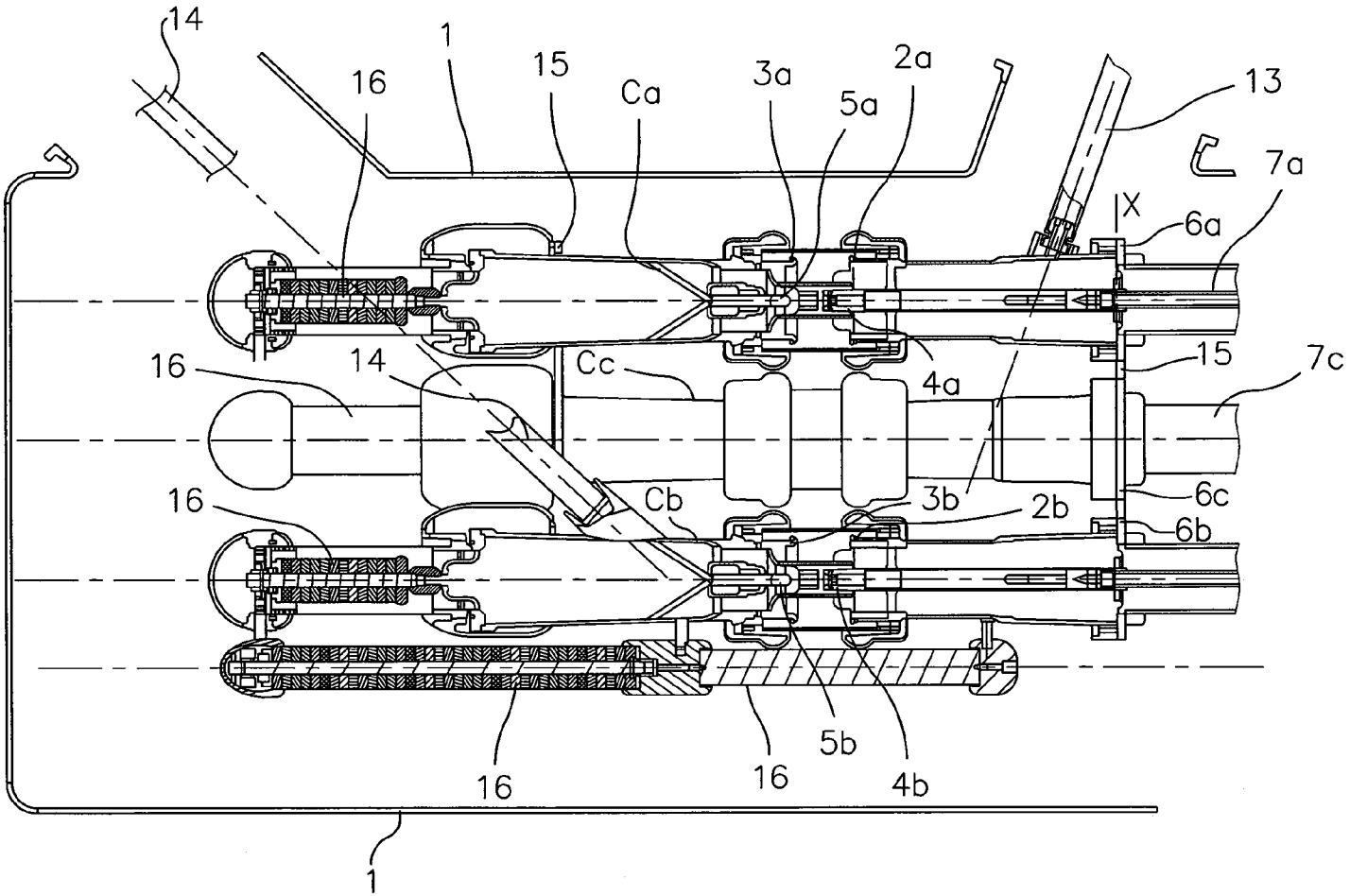
FIG. 2 is a view in section on two planes 120° apart, containing the axis of symmetry of the tank, with two breaker chambers of a very high voltage circuit breaker, in another embodiment of the invention, shown in its open position.

In the practice of the invention, the breaker chambers Ca, Cb, and Cc are first arranged parallel to one another in the tank 1 (see FIGS. 1A and 2). In the versions shown, they are arranged so as to make an angle θ of 120° between one another (see FIG. 1A).

Also in the practice of the invention, the ends 6*a*, 6*b*, and 6*c* of the respective chambers Ca, Cb, and Cc, through which the pair of movable contacts 2*a* and 4*a* or 2*b* and 4*b* of each chamber are driven, lie in a common plane X.

Finally in relation to the invention, the mechanical transmission that transmits simultaneous movement between the movable contacts 2*a* and 4*a* of the first chamber Ca, between the contacts 2*b* and 4*b* of the second chamber Cb, and between the contacts of the third chamber Cc, comprises three bars 7*a*, 7*b*, and 7*c* of equal length, each of which is coupled to the respective movable contacts 2*a* and 3*a*, or 2*b* and 4*b* of the chambers. The transmission also includes a yoke 8 coupled to the three bars 7*a*, 7*b*, and 7*c* and adapted to be coupled to a single drive rod 9 outside the tank 1.

Figure 1:
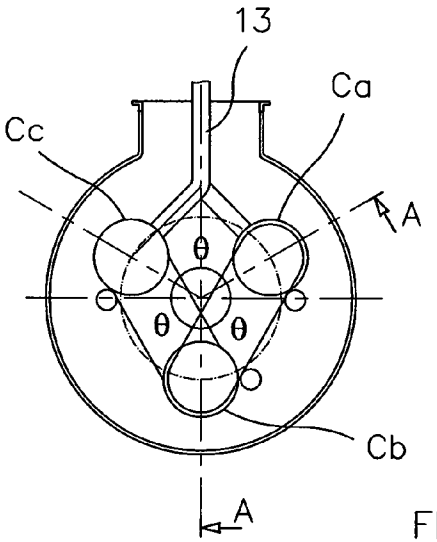
FIG. 1 is a view in cross section of a very high voltage circuit breaker in one embodiment of the invention.

In the version shown in FIGS. 1 and 1A, the yoke 8 is made of insulating material and is outside the tank 1. In the same way the bars 7*a*, 7*b*, and 7*c* are also made of insulating material, while the single drive rod 9 is of metal. In the configuration in which the yoke 8 is disposed inside the metal tank 1, the yoke 8 may be of insulating material, so that only one of the three bars 7*a*, 7*b*, 7*c* need then be of insulating material.

The bars 7*a*, 7*b*, and 7*c* may be of insulating material and the yoke of conductive material (metal). The yoke 8 may also pass through the wall of the tank (with a sealing system being provided for this purpose). As shown in FIG. 1A, the yoke 8 may be outside the tank 1 with three sealing systems (not shown), as an extension (in metal) of the insulating bars 7*a*, 7*b*, and 7*c*. In another version, the yoke 8 may be of insulating material.

In the version shown in FIGS. 1 and 1A, the breaker chambers Ca, Cb, and Cc are held in place, on only one side 10 of the circuit breaker D facing the drive rod 9, by means of insulating tubes constituting sleeves 11, which are fixed to the tank 1. More precisely, the yoke 8, the breaker chambers Ca, Cb, and Cc and the sleeves 11*a*, 11*b*, and 11*c* are fitted on an end cover member 10 before the circuit breaker D is assembled. The chambers Ca, Cb, and Cc of this sub-assembly are introduced into the body 12 of the tank, by positioning them in such a way that they are connected to the conventional sets of current input and output busbars 14. The cover member 10 is then fitted in place on the tank body 12.

The circuit breakers shown further include electrical connecting elements 15 for connection between the three breaker chambers Ca, Cb, and Cc to provide output means for the current, the said elements 15 being arranged parallel to the plane X in which the ends of the breaker chambers 6*a*, 6*b*, and 6*c* lie.

In the embodiments shown, the movable arcing contacts are in the form of tulips 4*a*, 4*b*, and the fixed contacts are in the form of rods 5*a* and 5*b*, each of which is extended in length by a tripod.

The architecture of the apparatus of the invention leads to easy fitting of resistive inserts 16 in line as shown in FIG. 2, and, by way of an advantage of the invention, along the longitudinal dimension (i.e. the axis of symmetry) of the tank. The embodiments shown are of particular advantage in very high voltage applications, above 800 kilovolts (kV).

The embodiment of FIG. 2 gives a more compact circuit breaker than that in FIGS. 1 and 1A, since the current input busbars 13 and output busbars 14 are arranged in the form of a V-shape that is convergent towards the inside of the tank 1 (see FIG. 2).

In an embodiment that is not shown, in which only two breaker chambers are arranged in the tank, such as for example two chambers Ca and Cb, a metal bar for electrical connection may be fitted in place of the third breaker chamber Cc. In such a configuration, a bar of the same kind as the bar 7*c* is omitted. In other words, the connecting bar is fixed and has no mechanical connection with the drive means. The use of a metal bar for electrical connection between the two breaker chambers is of advantage in those applications in which a predetermined distance is required between the current input 13 and output 14 in the circuit breaker. One application envisaged in this regard is a circuit breaker of the live tank type.

The invention is simple to make, and enables at least two, and typically three, standard breaker chambers to be used, the shape and dimensions of which do not have to be specific to the apparatus of this invention.

The advantages of the apparatus of the invention are many, for example the following:

reduction in length of the tank;

elimination of the need to transmit movement from one breaker chamber to another;

ease of transport of the circuit breaker of the invention;

resistive inserts can be fitted on the axis of the tank;

mechanical stresses on the insulating components of the drive means are reduced; and synchronization of the operation of at least two, and typically three, breaker chambers.

The invention claimed is:

1. A high or very high voltage circuit breaker comprising, for each phase, a metal tank in which there are mounted at least two breaker chambers connected electrically in series with each other, each breaker chamber including a pair of main contacts and a pair of arcing contacts, each of which is integral with one of the main contacts, wherein:

the breaker chambers are arranged arallel to each other in the tank;

the ends of the chambers, through which at least one pair of movable contacts of each chamber is driven, are situated in a common plane; and the mechanical transmission assembly, which effects the simultaneous transmission of movement and which determines identical path lengths for the movement of the movable contacts of at least two said chambers, comprises, firstly, at least two bars of identical lengths, each of which is coupled with the pair of movable contacts of one of the said chambers, and secondly, drive means coupled to the said bars and adapted to be coupled to at least one drive rod outside the tank or extending through a wall of the tank.

2. A high or very high voltage circuit breaker according to claim 1, wherein each pair of contacts consists of two movable contacts, with additional transmission means being provided for each chamber to separate its main and arcing contacts from each other during a current breaking operation.

3. A high or very high voltage circuit breaker according to claim 1, including drive means coupled to the bars, and drive rods, for performing separate control functions.

4. A high or very high voltage circuit breaker according to claim 1, wherein the drive means coupled to the said bars comprise a yoke adapted to be coupled to a single drive rod.

5. A high or very high voltage circuit breaker according to claim 4, wherein the yoke is arranged outside the tank.

6. A high or very high voltage circuit breaker according to claim 4, wherein the yoke is arranged inside the tank.

7. A high or very high voltage circuit breaker according to claim 4, wherein the yoke is made of an electrically insulating material and is coupled to the drive rod, which is made of an electrically conductive material.

8. A circuit breaker according to claim 4, wherein the yoke is made of an electrically conductive material and is coupled to the said bars which are made of electrically insulating material.

9. A high or very high voltage circuit breaker according to claim 1, wherein the mechanical retention of the breaking chambers in the tank is effected, only on the side of the circuit breaker that faces the drive rod or rods, by insulating elements in the form of sleeves that are fixed to the wall of the tank.

10. A high or very high voltage circuit breaker according to claim 1, including electrical connecting elements between the breaking chambers that serve for current output, at least a portion of the said elements being arranged parallel to the plane in which are situated the ends of the said breaking chambers through which the pair of movable contacts of each chamber is driven.

11. A high or very high voltage circuit breaker according to claim 10, having two, and only two, breaking chambers and wherein the electrical connecting elements comprise a metal bar arranged inside the tank parallel to the chambers, the bar being connected to the portions of the electrical connecting elements that are disposed parallel to the plane of the ends of the said chambers through which the pair of movable contacts of each chamber are driven.

12. A high or very high voltage circuit breaker according to claim 1, wherein the breaking chambers are made with vacuum chambers.

13. A high or very high voltage circuit breaker according to claim 1, when disposed in an orientation other than horizontal, as part of a dead tank.

14. A circuit breaker according to claim 1, further including a metalclad switchgear unit.

15. A method of mounting a circuit breaker according to claim 1, in which a step of making a sub-assembly consisting, at least, of two breaking chambers, and drive means to be coupled to the bars, assembled on a cover member of the tank, and in which at least the two breaking chambers are then fitted in the tank by closing the body of the tank with the sub-assembly.

* * * * *